United States Patent [19]

Clarke

[11] 4,240,897

[45] Dec. 23, 1980

[54] OIL SANDS HOT WATER EXTRACTION PROCESS

[76] Inventor: Thomas P. Clarke, 211 14810 51 Ave., Edmonton, Alberta, Canada, T6H 5G5

[21] Appl. No.: 64,313

[22] Filed: Aug. 6, 1979

[30] Foreign Application Priority Data

Jun. 6, 1975 [CA] Canada ..... 279952

[51] Int. Cl.[3] ..... C10G 1/04

[52] U.S. Cl. ..... 208/11 LE; 405/129

[58] Field of Search ..... 208/11 LE

[56] References Cited

U.S. PATENT DOCUMENTS

| | | | |
|---|---|---|---|
| 2,903,407 | 9/1959 | Fischer et al. | 208/11 LE |
| 2,940,919 | 6/1960 | Hemminger | 208/11 LE |
| 3,075,913 | 1/1963 | Scheffel et al. | 208/11 LE |
| 3,338,814 | 8/1967 | Given et al. | 208/11 LE |

*Primary Examiner*—Herbert Levine

*Attorney, Agent, or Firm*—Lawrence I. Field

[57] ABSTRACT

In a hot water extraction process for removing bitumen from oil sands, the efficiency is improved by filtering the wet tailings to recover hot water, bitumen and diluent which are returned and recovered in the process. Dry tailings are also produced which can be disposed of in a manner which permits reconservation of the mined out area and which eliminates environmental pollution impact on surrounding water bodies and land bodies.

3 Claims, 1 Drawing Figure

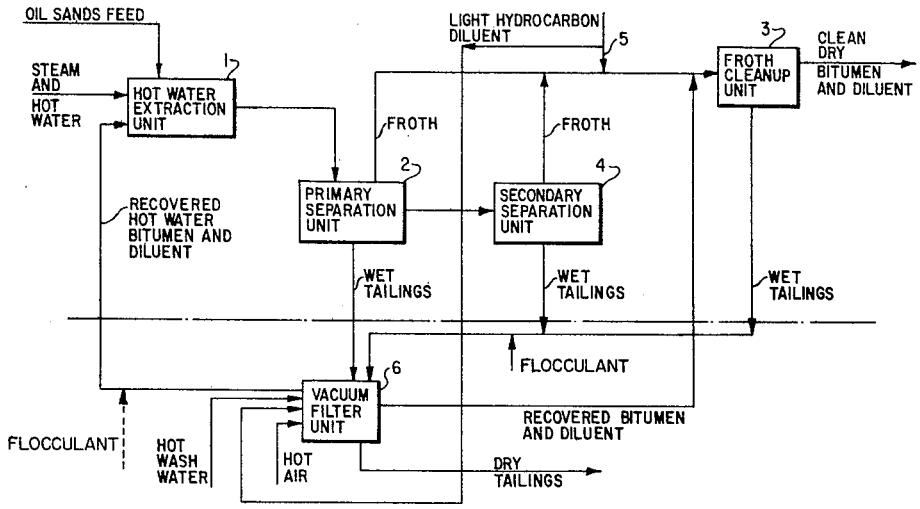

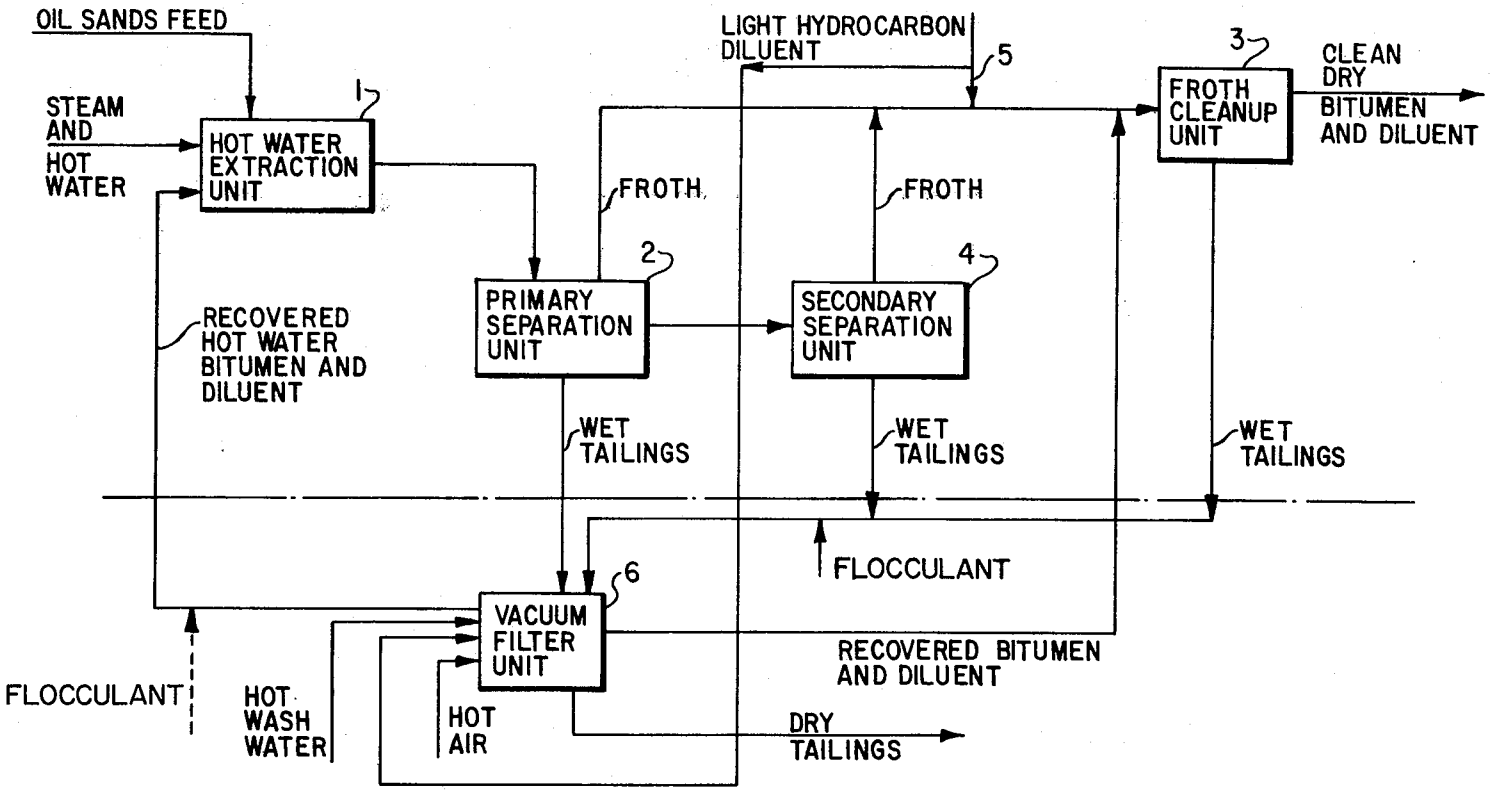
OIL SANDS FEED
STEAM AND HOT WATER
1
HOT WATER EXTRACTION UNIT
RECOVERED HOT WATER BITUMEN AND DILUENT
LIGHT HYDROCARBON DILUENT
5
FROTH
2
PRIMARY SEPARATION UNIT
WET TAILINGS
FROTH
4
SECONDARY SEPARATION UNIT
WET TAILINGS
3
FROTH CLEANUP UNIT
CLEAN DRY BITUMEN AND DILUENT
WET TAILINGS
FLOCCULANT
6
VACUUM FILTER UNIT
RECOVERED BITUMEN AND DILUENT
DRY TAILINGS
HOT AIR
HOT WASH WATER
FLOCCULANT

OIL SANDS HOT WATER EXTRACTION PROCESS

BACKGROUND OF THE INVENTION

This invention relates to an improvement in the operation of an oil sands hot water extraction plant.

In the extraction of oil from oil sands, oil bearing material is mined, usually by a bucket wheel excavator or dragline, and is transported for hot water extraction processing in which it is mixed with hot water such that the bitumen floats as a froth and the solid matter sinks, making it possible to skim off the froth for further separation and eventual refinement to finished products, and dump the solid matter.

Presently 87% by weight of bitumen and diluent naphtha are recovered from the oil sands by this hot water extraction process with a loss of 13% by weight being dumped with the solid matter. The disposing of the solid matter involves passing the solid matter together with accompanying hot water from the hot water extraction process out to tailings ponds. The hot water which is lost is at a temperature of approximately 185°–195° F. The loss of this hot water considerably reduces the overall plant thermodynamic efficiency as the heat loss must be made up when reheating cold water for the hot water extraction process.

In present commercial operations, the tailings containing solid matter, hot water, and hydrocarbons not removed by the hot water extraction process, are sluiced, after the process, into retaining areas which are often large ponds formed from dams or dykes built from the tailings. When the first pond has been filled, a second dam is built in the mined out area and this process of building dams and filling the ponds formed between the dams is continued until the reserve of mineable oil sands has been depleted. At this future time most of the area of the mined out acreage will be covered under almost a continuous pond consisting of water, oil emulsions, and clay fines gel. With the present method of tailings disposal, environmental authorities have determined that there has been and will continue to be pollution impacts on underground water streams, surrounding lakes and other fresh water bodies adjacent to the mining areas. Under the present tailings disposal little, if any, of the mined out land can be reclaimed and put to useable form since it will all be under the water, oil emulsion and unstable clay fines gel.

The basic method of recovery of oil from oil sands is disclosed in the following Canadian patents, however none of these patents are concerned with the efficiency of the system but only with general methods and apparatus for removing the oil. The disposal of the tailings and the deleterious environmental impact of the tailings on the land and surrounding water bodies were not considered of importance nor even recognized in these patents.

| Patent No. | Date | Patentee |
|---|---|---|
| 448,231 | May 4, 1948 | Karl Adolf Clark |
| 488,928 | Dec. 16, 1952 | Oil Sands Limited |
| 493,081 | May 26, 1953 | Robert C. Fitzsimmons |

Some of the major hitherto unresolved problems in the continued development of the oil sands are (1) to increase the recovery of bitumen from the sands and limit the loss of diluent use in a hot water extraction process, (2) to increase the thermodynamic efficiency of the overall process by recovery of hot water which is presently lost in the tailings ponds, (3) to reclaim the mined out areas, leaving them in a useable form, and (4) to eliminate the environmental impact of pollution of surrounding bodies of water by seepage of contaminated sluice pond water into fresh water bodies and underground streams, etc. It has been observed that large bitumen losses; considerably larger than indicated above; occur in commercial operation periodically due to plant malfunctions or upsets due to many causes. This invention acts as a safeguard back-up system to recover approximately 99% by weight of such high commercial bitumen losses whether continuous or discontinuous.

SUMMARY OF THE INVENTION

This invention overcomes these unresolved problems by passing the various liquid tailings through a further separation step in which the hot water is recovered together with hydrocarbons, this recovered liquid being returned into the hot water extraction process and the froth cleanup unit. The tailings which remain are then almost dry and can be disposed of in the mined out areas. It is preferable, although not essential, to utilize a vacuum filtration process for extraction of the hot water and hydrocarbons, this process utilizing filter cloths and filter cakes made from the dried tailings.

By utilizing this invention, the following advantages are achieved over all known processes:

1. Essentially most of the hot water is recovered from the tailings streams of the hot water extraction plant and is recycled within the process thus increasing the thermodynamic efficiency of the process. There is thus a considerable saving in energy required to operate the process.

2. As the hot water and hot solvent extracting diluent are recycled within the hot water extraction and the froth cleanup units, additional bitumen and diluent are recovered and the extraction efficiency rises to approximately 99% by weight from the present recovery of 87% by weight.

3. As wet tailings are not being disposed of, the need for dams or dykes is not required and land reclamation problems and operational problems involved with the present wet tailings systems are eliminated thus making additional land available for mining.

4. As the wet tailings ponds are eliminated, the environmental pollution impact on all land and water bodies in the area of the mining operation is minimized.

5. As dry tailings are being disposed of, they can be mixed with overburden thus increasing the soil stability of the disposal area and enabling the land to be reclaimed. Revegetation and regrowth can begin as soon as the commercial development starts, thus eliminating the necessity to wait for years or decades until the present tailings ponds dry up and disappear.

6. By increasing the efficiency of the process, poorer grades of oil sands can be worked, thus permitting greater flexibility in the mining and mixing of varying grades and qualities of oil sands.

7. The capacity of the boiler plant can be considerably reduced as the recovered hot water which is recycled in the hot water extraction process saves approximately half of the boiler plant requirements over the present systems if included in the initial plant design. If converting an existing plant, additional boiler capacity is achieved which can be used to increase the size of the facilities.

8. Increased hydrocarbon yields and increased energy conservation lead to a reduction in capital and operating costs per unit barrel of synthetic crude oil production.

BRIEF DESCRIPTION OF THE DRAWINGS

The invention will now be described with reference to the accompanying drawing in which a block diagram of the process is shown.

DETAILED DESCRIPTION OF PREFERRED EMBODIMENT

Referring to the drawing, the conventional process including known improvements is indicated above the chain line and consists generally of feeding oil sands from a mining area into a hot water extraction unit 1. The hot water and oil sands are mixed and then transported as a pulp to a primary separation unit 2 where the major separation of oil in the form of froth, consisting of recoverable bitumen, water and mineral matter, and solid tailings occurs. A middlings stream is also formed with part being transported to a secondary separation unit 4 and part being recycled back to unit 1. The froth is transported to a froth clean-up unit 3 wherein the froth is mixed with a light hydrocarbon diluent from stream 5 to assist in the clean-up process. A secondary separation unit 4 is utilized to recover more bitumen from the oil and water middlings stream from the primary separation unit 2. The bitumen recovered from the secondary separation unit 4 is transported, together with the primary recovered bitumen froth stream to the froth clean-up unit 3. Clean dry bitumen and diluent are obtained from the froth clean-up unit 3 and the solid matter is discharged as wet tailings. The clean dry bitumen plus diluent are then transported to upgrading facilities where the diluent is separated and returned to stream 5 and the bitumen is upgraded to synthetic crude oil.

The improvement in the conventional system is to now collect the wet tailings from the primary separation unit 2, the secondary separation unit 4, and the froth clean-up unit 3 and transport them to a vacuum filter unit 6.

A vacuum filter unit which is satisfactory for this purpose has an number of radially disposed filtration segments which provide for a continuous operation. Each segment in turn is passed under the wet tailings stream from the primary separation unit 2, this being the stream which includes the bulk of the solid material. The wet tailings in a segment is vacuum filtered to recover bitumen and hot water and forms a tailings cake. The dried cake is then passed under the wet tailings streams from the secondary unit 4 and the froth clean-up unit 3 and again the cake is dewatered by vacuum filtration to recover the hot water, bitumen and diluent filtrate which is recovered and returned to the hot water extraction unit 1. For more efficient utilization of the filter, the wet tailings streams from the secondary separation unit 4 and froth clean-up unit 3 maybe added into the massive wet tailings stream from the primary separation unit 2 which will act as a wet tailings cake bed for the tailings from units 3 and 4. The combined wet tailings are then vacuum filtered to recover bitumen, diluent and hot water and form a tailings cake. To aid the filtration rate, the feed to the filters may be elutriated with hot water and a portion of the relatively solid free liquid layer maybe decanted and combined with the filtrate stream for recycle to the hot water extraction system unit 1. The dried filter cake is then passed under a hot solvent extraction diluent to extract bitumen and the diluent filtrate recovered separately and forwarded to the froth clean-up unit 3 where the diluent portion can be utilized in the froth clean-up unit. The dried cake is then passed under a hot wash water stream to recover more bitumen and diluent and hot wash water from the cake. The recovered bitumen, diluent and hot water filtrate is recovered and forwarded to the hot water extraction unit 1. Finally, the segment is rotated through 180° to discharge the dry cake, the filter cloth is washed and dried, and the cycle can again begin.

The discharge dried filter cake can then be transported to a dry tailings disposal area whereas all the liquid hydrocarbons and hot water recovered during the filtration will be passed back into the hot water extraction plant 1 and the froth clean-up unit 3.

To aid filtration of the "fines" mineral matter contained in the wet tailings streams from the secondary separation unit 4 and the froth clean-up unit 3, a flocculant can be added to these wet tailings before they are passed into the vacuum filter unit 6. Depending on the type of oil sands feed-clay mixture mined and delivered to the hot water extraction unit 1, as well as the mode of operation of the vacuum filter unit 6, the flocculant may be added to the recovered and recycled hot water-bitumen stream prior to re-entry to the hot water extraction unit 1. The flocculated precipitate portion of said stream may be returned and removed in, but not limited to, the froth clean-up unit 4 and vacuum filter unit 6, or be sent directly to a tailings dump. Thus the fine clay particles concentration in the hot water extraction system may be kept at whatever concentration the individual plant operation may require or desire. The clay concentration varies greatly with the type of oil sands feed as well as with the design of various components of the hot water extraction 1, primary separation unit 2, secondary separation unit 4, froth clean-up unit 3, vacuum filter unit 6, and type of flocculant used as well as the operational objectives and policies of each organization involved in oil sands operation.

Additional steam and hot water are introduced directly into the hot water extraction unit together with the oil sands feed to provide make-up water requirements and to raise the temperature of the oil sands feed to the required operating temperature.

By using the vacuum filter unit 6 to process all of the wet tailings, additional bitumen and diluent are recovered, the hot water is recovered, and the mineral matter is dried so that it can be transported by conveyor belt or other conventional type of transportation to the mined out disposal area. The dry tailings can be mixed with overburden and stacked in the mined out area by means of stackers or other conventional mining equipment to increase the stability of the soil in the disposal area and reduce the water content of the total overburden and tailings solids. Reclamation of the disposal area can then begin immediately.

It will thus be seen that a novel and extremely useful improvement has been made to the conventional oil sands hot water extraction process, this improvement clearly falling within the guidelines which have been laid down by the Alberta Energy Resources Conservation Board and the Alberta Oil Sands Environmental Research Project. These guidelines apply to present operators, future operators, approved applicants and all future applicants to be approved for oil sands surface mining projects and are as follows:

1. Improve the recovery yield of bitumen and saleable synthetic crude oil above the present level.

2. Improve the thermodynamic efficiency of project operations by reducing heat and other forms of energy losses.

3. Reclaim the mined out land area.

4. Reduce, or remove and eliminate, any causes of environmental impact on the land, water and air.

Although the invention has been described utilizing a vacuum filter unit, it is understandable that any type of separation unit which can remove liquids from solid matter as encountered in oil sands could be used bearing in mind that the separation unit must be capable of handling vast quantities of material in a continuous operation.

The embodiments of the invention in which an exclusive property or privilege is claimed and defined as follows:

1. An improvement in a hot water extraction process for removing bitument from oil sands, the process using a primary separating unit, a secondary separating unit and a froth clean-up unit, the improvement consisting of:

a. passing first wet tailings from the primary separating unit into a vacuum filter segment having a filter medium;

b. elutriating the first wet tailings in the filter segment with hot water;

c. decanting a portion of solid free liquid from the main body in the filter segment above the filter medium, and returning the decanted portion to the primary separating unit;

d. vacuum filtering the main body of first wet tailings through the filter medium to recover bitument and hot water and form a tailings filter cake above the filter medium;

e. passing second wet tailings from the secondary separation unit and froth clean-up unit onto the filter cake;

f. elutriating the second wet tailings in the filter segment with hot water;

g. decanting a portion of solid free liquid from the main body of second wet tailings in the filter segment above the filter cake and returning the decanted portion to the primary separating unit;

h. vacuum filtering the main body of second wet tailings through the filter cake and the filter medium to recover bitumen, hot water and diluent;

i. passing hot solvent diluent through the filter cake to extract bitumen from the cake;

j. passing hot water through the filter cake to recover more bitumen and diluent which was retained therein in step i;

k. subjecting the filter cake to vacuum to reduce its moisture content;

l. rotating the filter segment and discharging the filter cake for transportation of conventional materials handling equipment to a waste dumping site; and m. washing and drying the filter medium and rotating the filter segment to its original position.

2. The process of claim 1, wherein the second wet tailings from the secondary separation unit and third wet tailings from the froth clean-up unit are added to the first wet tailings from the primary separating unit and introduced in step (a), thus eliminating steps (e), (f), (g) and (h).

3. The process of claims 1 or 2, including removing clay fines from the separated liquids by introducing a flocculant before recycling the liquids through the primary separation unit.

* * * * *

UNITED STATES PATENT OFFICE

CERTIFICATE OF CORRECTION

PATENT NO. : 4,240,897

DATED : December 23, 1980

INVENTOR(S) : THOMAS P. CLARKE

It is certified that error appears in the above-identified patent and that said Letters Patent are hereby corrected as shown below:

Column 5, line 22 (Claim 1, line 2); correct --bitumen--.

Column 5, line 37 (Claim 1, line 16); correct --bitumen--.

Title Page, delete -- [30] Foreign Application Priority Data -- in its entirety.

Signed and Sealed this

*Twenty-fourth* Day of *August 1982*

[SEAL]

*Attest:*

GERALD J. MOSSINGHOFF

*Attesting Officer*

*Commissioner of Patents and Trademarks*